US008273213B2

(12) United States Patent
Pringle et al.

(10) Patent No.: US 8,273,213 B2
(45) Date of Patent: Sep. 25, 2012

(54) TISSUE PRODUCT, METHOD OF MANUFACTURE OF A TISSUE PRODUCT AND APPARATUS FOR EMBOSSING A TISSUE PLY

(75) Inventors: Mike Pringle, Kenton Newcastle Upon Tyne (GB); Anna Mansson, Molndal (SE); Kim Danielsson, Hango (FI)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/177,254

(22) Filed: Jul. 6, 2011

(65) Prior Publication Data

US 2011/0262719 A1 Oct. 27, 2011

Related U.S. Application Data

(60) Division of application No. 11/710,464, filed on Feb. 26, 2007, now Pat. No. 7,985,319, which is a continuation of application No. PCT/EP2004/014628, filed on Dec. 22, 2004.

(30) Foreign Application Priority Data

Aug. 31, 2004 (DE) ..... 20 2004 013 598 U

(51) Int. Cl.
*D21F 11/00* (2006.01)

(52) U.S. Cl. ..... 162/117

(58) Field of Classification Search ..... 162/117, 162/109, 125, 362; 425/363
See application file for complete search history.

(56) References Cited

U.S. PATENT DOCUMENTS

| | | | |
|---|---|---|---|
| 5,913,765 | A | 6/1999 | Burgess et al. |
| 6,344,110 | B1 | 2/2002 | Reiner |
| 6,451,168 | B1 | 9/2002 | Talja |
| 2002/0056536 | A1 | 5/2002 | Lamb |
| 2002/0060007 | A1 | 5/2002 | Hollmark et al. |
| 2003/0070780 | A1 | 4/2003 | Chen |
| 2003/0198788 | A1 | 10/2003 | Andersson |
| 2004/0200590 | A1 | 10/2004 | Wilhelm |

FOREIGN PATENT DOCUMENTS

| | | |
|---|---|---|
| EP | 0 408 248 | 1/1991 |
| GB | 2 380 447 | 4/2003 |
| RU | 2 162 414 | 1/2001 |
| RU | 2 196 197 | 5/2002 |
| RU | 2 211 271 | 6/2002 |
| RU | 2 211 273 | 8/2003 |
| WO | 97/20688 | 6/1997 |
| WO | 97/47227 | 12/1997 |
| WO | 00/20684 | 4/2000 |
| WO | 2004/057110 | 7/2004 |

*Primary Examiner* — Mark Halpern
(74) *Attorney, Agent, or Firm* — Young & Thompson

(57) ABSTRACT

A one-ply tissue product includes a first external surface and a second external surface, the first surface having a wet-formed pattern and the second surface having an embossed pattern imitating the wet-formed pattern. Additionally, also multi-ply tissue product is suggested comprising at least two plies including two outer plies, each outer ply having a first surface and a second surface, one outer ply having a wet-formed pattern on at least the first surface and the other outer ply having an embossed pattern on at least the first surface imitating the wet-formed pattern on the first surface of the one outer ply, both outer plies being brought together so that their respective first surfaces represent external surfaces of the multi-ply tissue product. Moreover, a corresponding method and an embossing unit are also disclosed.

6 Claims, 3 Drawing Sheets

TISSUE PRODUCT, METHOD OF MANUFACTURE OF A TISSUE PRODUCT AND APPARATUS FOR EMBOSSING A TISSUE PLY

CROSS REFERENCE TO RELATED APPLICATION

This application is a division of application Ser. No. 11/710,464 filed on Feb. 26, 2007; which is a continuation of International application PCT/EP04/14628 filed on Dec. 22, 2004; which claimed priority to German application 20 2004 013 598.1 filed Aug. 31, 2004. The entire contents of each of the above-identified applications are hereby incorporated by reference.

FIELD OF THE INVENTION

The present invention relates to a tissue product comprising at least one ply, preferably two or three plies. In addition, the present invention relates to a corresponding method of manufacturing such tissue products and to an apparatus for embossing a tissue ply having an embossing roller and a counter roller.

BACKGROUND OF THE INVENTION

As aforesaid, the present invention particularly relates to the manufacture of a tissue product and, thus, to the production and processing of a tissue ply or tissue web, respectively. Tissue is defined as a soft absorbent paper having a low basis weight. One generally selects a basis weight of 8 to 30 g/m$^2$, especially 10 to 25 g/m$^2$ per ply. However, the basis weight may also be up to 50 g/m$^2$ and typically up to 40 g/m$^2$. The total basis weight of multiple ply tissue products resides in a range of 16 up to 100 g/m$^2$ and particularly up to approximately 80, 70 or 50 g/m$^2$. Its density is typically below 0.60 g/cm$^3$, particularly below 0.30 g/cm$^3$ and more preferably between 0.08 and 0.20 g/cm$^3$.

The production of tissue is distinguished from paper production as such by its extremely low basis weight and its much higher tensile energy absorption index (see DIN EN 12625-4 and DIN EN 12625-5). Paper and tissue also differ in general with regard to the modulus of elasticity that characterizes the stress-strain properties of these planar products as a material parameter.

Tissue is made out of pulp, the process and the apparatus, respectively essentially comprising:

I: A forming section including the head box and the forming fabric portion,

II: Pressing or TAD (through air drying)

III: Yankee cylinder or other drying means.

IV: Creping.

V: Other after treatments, monitoring and winding area.

Step I-II in the above-mentioned process steps comprises dryness values of up to 40%. In a TAD for example the ingoing dryness values could approximately be about 20% and the outgoing dryness values could for example be from about 60-650, which would require further drying, to about 90-95%. Step III and IV are optional.

In the prior art, several techniques are known to impart the tissue ply with a 3-dimensional pattern.

One technique is wet forming of the ply. The definition of wet-forming is that a 3-dimensional pattern is formed in a wet stage while the fibres may still be moved, preferably the fibers are dried in this position. Up to dryness values of approximately up to 40% the fibers are considered to have the ability to move within the web. The wet forming of the ply can be conducted by means of the forming fabric, the TAD fabric or the transfer fabric (i.e. the fabric used to transfer the tissue ply from the forming section to e.g. the TAD section), the ply being in contact with these fabrics so that a pattern is formed, which is imparted by the fabric. This pattern may result to a certain increased volume of the paper and further a textile appearance. Beside the fabrics, such a pattern may be provided in the wet-forming portion by means of rollers, felts or belts. In this context a belt is an alternative of a fabric and comprises a supporting substrate with an applied resin structure or pattern. Similar as in a fabric, also the structure of the belt includes knuckles and pockets, however, not being formed by warp and weft yarns, but by the applied resin structure.

Another technique used in the prior art is embossing. Micro as well as macro embossing and also decorative embossing is known in the prior art for converting tissue paper web obtained from the paper machine to a finished tissue product, wherein converting is also known as processing of the tissue paper web in order to provide one or more tissue plies forming the final tissue paper product. In this understanding the continuous paper web may be named a tissue ply when processed and converted in a converting machine. In addition, a so-called pre-embossing of a tissue ply is known upstream of lamination to a finished e.g. multiply tissue product. The aforementioned processes are done when the paper is dry.

A wet-formed pattern being imparted in a wet state much better maintains its structure at rewetting compared to a pattern introduced in a dried state, e.g. by means of embossing.

In addition, two-ply tissue products are known in the prior art, which products comprise two plies, both plies being produced on e.g. a TAD paper machine, i.e. TAD is used for drying. Each ply on both of its surfaces has a wet-formed pattern (imparted by the TAD fabric). There is a pattern on the fabric side of the ply, i.e. the side of the ply being in direct contact with TAD-fabric, which has the negative surface topography of the TAD-fabric or the imprint of the TAD-fabric. In addition, there is also a pattern on the side of the ply opposite the fabric side, being also imparted by the TAD-fabric, however, being substantially the positive of the TAD-fabric. The two plies are brought together so that the two opposed external surfaces of the two-ply tissue product have the same or opposite appearance. I.e. either the fabric sides represent the external surfaces or the sides opposite to the fabric sides.

A TAD paper is more expensive compared to tissue paper being manufactured in a machine having no TAD section. However, the textile appearance of the more expensive TAD paper and more essentially the higher absorption capacity is more desired by the customer. In contrast there are advantages of tissue paper having no intentionally imparted wet-formed pattern (non-wet-formed tissue paper) compared to TAD paper, such as printability. This also applies vice versa as far as other properties of the respective materials are concerned.

SUMMARY OF THE INVENTION

Based on the above discussion it is the technical problem of the present invention to provide a tissue product that has an improved visual appearance and a similar dry surface feeling on both of its outer sides and, in case of a multi-ply tissue product, that can be produced more cost-effectively without affecting the visual appearance, and to provide a corresponding method of manufacture and an apparatus for embossing a tissue ply so as to improve its visual appearance.

A one-ply tissue product according to an embodiment of the invention comprises a first external surface and a second external surface, the first surface having a wet-formed pattern and the second surface having an embossed pattern imitating the wet-formed pattern. The embossed pattern being formed in the dry state of the ply. In case the one ply is e.g. a TAD ply, the corresponding paper web leaving the paper machine is two-sided, i.e. the paper has two different sides, one rougher side and one smoother side. The rougher side contacted the TAD fabric, i.e. the rougher side is the fabric side. Both afore-mentioned sides have a pattern imparted by the TAD-fabric and the terminology "wet-formed" pattern includes either one thereof, the one imparted on the fabric side and the one imparted on the opposite side thereof. For example, by applying an embossed pattern on the rougher side, the roughness is partly overcome (i.e. softened) and the dry surface feeling is similar to the dry surface feeling on the smoother side, i.e. the side opposite the fabric side. Further both sides will have a similar visual appearance. In this case, the embossed pattern imitates the wet-formed pattern imparted by the TAD-fabric on the side of the paper opposite the fabric side. In other words, the embossed pattern has a similar (positive) surface topography as the TAD-fabric. Alternatively, the embossed pattern may also be applied to the smoother surface imitating the wet-formed pattern on the rougher surface. In other words, the embossed pattern has a surface topography similar to the negative of the surface topography of the TAD-fabric. It is conceivable that the one ply has not been subjected to TAD and that the wet-formed pattern is imparted by another means than the TAD-fabric, but still in the wet state of the ply as defined above.

In addition, the present invention also provides a multi-ply tissue product comprising at least two plies including two outer plies, each outer ply having a first surface and a second surface, one outer ply having a wet-formed pattern on at least the first surface and the other outer ply having an embossed pattern on at least the first surface imitating the wet-formed pattern on the first surface of the one outer ply, both outer plies being brought together so that their respective first surfaces represent external surfaces of the multi-ply tissue product. In addition to the outer plies, as described, there may also be one intermediate ply or more intermediate plies. The intermediate ply or plies might be any kind of tissue paper, TAD ply or plies, dry-creped tissue ply or plies, as well as ply or plies without any intentional wet-formed pattern or any combination thereof. The two outer plies, thus, may be brought together directly in a two-ply tissue product or indirectly via a middle ply or plies in a three- or more-ply tissue product. As in the embodiment above, the terminology "wet-formed" includes any kind of pattern imparted to the paper web in the wet state. For example, if a fabric is used to impart the pattern both external surfaces may be imparted with a pattern and either one of these patterns is covered by the above terminology. In particular, if e.g. a TAD fabric is used as the one outer ply, the rougher surface or the smoother surface of the paper web may be used as external surface of the tissue product. Depending on which surface is used, the pattern on the other outer ply is embossed correspondingly in the same or at least a similar pattern. Hence, as above mentioned, the embossed pattern on the other outer ply may have a surface topography similar to the positive or the negative of the surface topography of the fabric used to impart the wet-formed pattern on the one outer ply.

According to one preferred embodiment of the inventive multi-ply tissue product, at least the two outer plies are obtained from different paper machines. As a result, the outer plies having different properties may be brought together improving the overall properties of the tissue product. Though both outer plies are obtained from different paper machines the visual appearance of the external surfaces of the tissue product is at least similar.

Preferably, one ply is a TAD web obtained from a TAD paper machine and the other ply is a non-wet-formed tissue web. In this context the term "non-wet-formed" means that in the wet state, as defined in the introductory part, the ply is not intentionally imparted with a pattern or 3-dimensionality, resp. For example, a tissue ply manufactured without being subjected to TAD and which also in the sections upstream the drying section is not subjected to wet-forming is considered as being non-wet-formed. It is to be understood that also a ply which has a pattern for example imparted by the forming fabric is considered as being non-wet-formed, as long as the pattern is not intended for decorative or functional purposes, but results of the conventional paper machine technique.

In one embodiment, the embossed pattern of the above embodiments of the present invention has pocket and knuckle imprints. Depending on the surface to be imitated, the pocket imprints form depressions and the knuckle imprints form protrusions on the ply or vice versa. Referring to the above example of a TAD-ply having a wet-formed pattern on both external surfaces, the knuckle imprints of the embossed pattern form protrusions and the pocket imprints of the embossed pattern form depressions, in case the smoother surface (i.e. the side opposite the fabric side) of the TAD-ply or -web is to be imitated. In this case the surface topography of the embossed pattern is the same or at least similar to surface topography of the TAD-fabric used to impart the wet-formed pattern, wherein the surface topography of the embossing pattern is the same or at least similar to the negative surface topography of the TAD-fabric. On the other hand, if the rougher surface (the fabric side) of the TAD-ply is to be imitated, the knuckle imprints of the embossed pattern form depressions and the pocket imprints of the embossed pattern form protrusions. In this case, the surface topography of the embossed pattern is the same or at least similar to the negative of the surface topography of the TAD-fabric used to impart the wet-formed pattern.

The knuckle imprints extend substantially in parallel to the machine direction and are spaced apart from each other in the cross-machine direction. The machine direction is defined as a transport direction of the ply or web during tissue manufacturing, respectively. The cross-machine direction is defined as the direction perpendicular to the machine direction, the knuckle imprints having a substantially linear form. In this embodiment the knuckle imprints line up in linear ridges in a direction angled to the machine direction and to the cross-machine direction. In this context, the knuckle imprints, as aforesaid, may be present in the form of depressions or protrusions.

According to a preferred embodiment of the present invention, the embossed pattern comprises less than 30 protrusions per $cm^2$. The protrusions are the areas defined by the knuckle or pocket imprints.

The embossed pattern of the tissue product described above may have a textile-like surface topography.

In addition, it is preferred that the wet-formed pattern is formed by a means selected from the group of a forming fabric, a TAD fabric, a transfer fabric, a felt, a belt, a roller or combinations thereof. In this context a belt is an alternative of a fabric and comprises a supporting substrate with an applied resin structure or pattern. Similar as in a fabric, also the structure of the belt includes knuckles and pockets, however, not being formed by warp and weft yarns, but by the applied resin structure and mechanical treatment thereof. It is to be understood that wet-formed means that the pattern is imparted to the ply in a state in which the ply still has movable fibres within the ply, which normally corresponds to dryness values of approximately up to 40%, as explained in the introductory part and that all techniques to impart such a wet-formed pattern, known in the art, are to be covered by the present invention.

In addition to the tissue product, the present invention also provides a method of manufacturing a one-ply tissue product having two external surfaces. The method of manufacture comprises the steps of producing a tissue ply so that at least one of its external surfaces has a wet-formed pattern. The wet-formed pattern may be generated by any kind of technique as aforesaid. In addition also in this case, the term "wet-formed" not only covers the pattern on the side of the ply in direct contact with the means imparting the wet-formed pattern but also the pattern on the opposite side. In addition, the method comprises embossing the other external surface of the ply opposed to the said one external surface in a pattern imitating the wet-formed pattern of the wet-formed pattern formed on said one external surface.

Also provided is a method of manufacturing a multi-ply tissue product having at least two plies including two outer plies, and two opposed external surfaces. In this case, the method comprises the steps of producing a first ply on a first paper machine, the first ply having a wet-formed pattern on at least one of its two external surfaces; producing a second ply on a second paper machine, embossing the second ply on at least one of its two external surfaces in a pattern imitating the wet-formed pattern of the first ply and finally bringing together the first ply and the second ply so that the wet-formed pattern and the embossed pattern form the two external surfaces of the multi-ply tissue product. In addition to a first ply and a second ply, there may also be a middle ply or plies, as previously mentioned. Hence, the outer plies may be brought together directly or indirectly. In addition the discussing of the multi-ply tissue product also applies for the corresponding method so that the reader is referred to the above passage.

Besides the method of manufacture, the present invention also provides an apparatus for embossing a tissue ply comprising an embossing roller and a counter roller. Compared to conventional apparatuses for embossing, the embossing roller has a pattern that corresponds to the surface topography or the negative surface topography of a fabric, a felt, a belt or a roller, in general used to obtain a wet-formed pattern on a ply during production of the tissue ply.

The apparatus according to the present invention preferably has a pattern that imitates yarns and/or filaments of the fabric used for a/the wet-formed pattern or the negative thereof.

The apparatus may be a part of a converting machine, in which a one-ply- or multi-ply-product is manufactured.

BRIEF DESCRIPTION OF THE DRAWINGS

Further features and advantages of the present invention will be apparent from the following detailed description referring to the accompanying drawings, in which:

FIG. 3 is a plan view on the fabric; FIG. 3 is a plan view on an embossing pattern according to one embodiment of the present invention developed into a surface plane.

DESCRIPTION OF A PREFERRED EMBODIMENT

In the following, a preferred embodiment of the present invention is described referring to the accompanying drawings. The embodiment is only intended to exemplify the present invention and has no limiting purpose.

Figure 1:
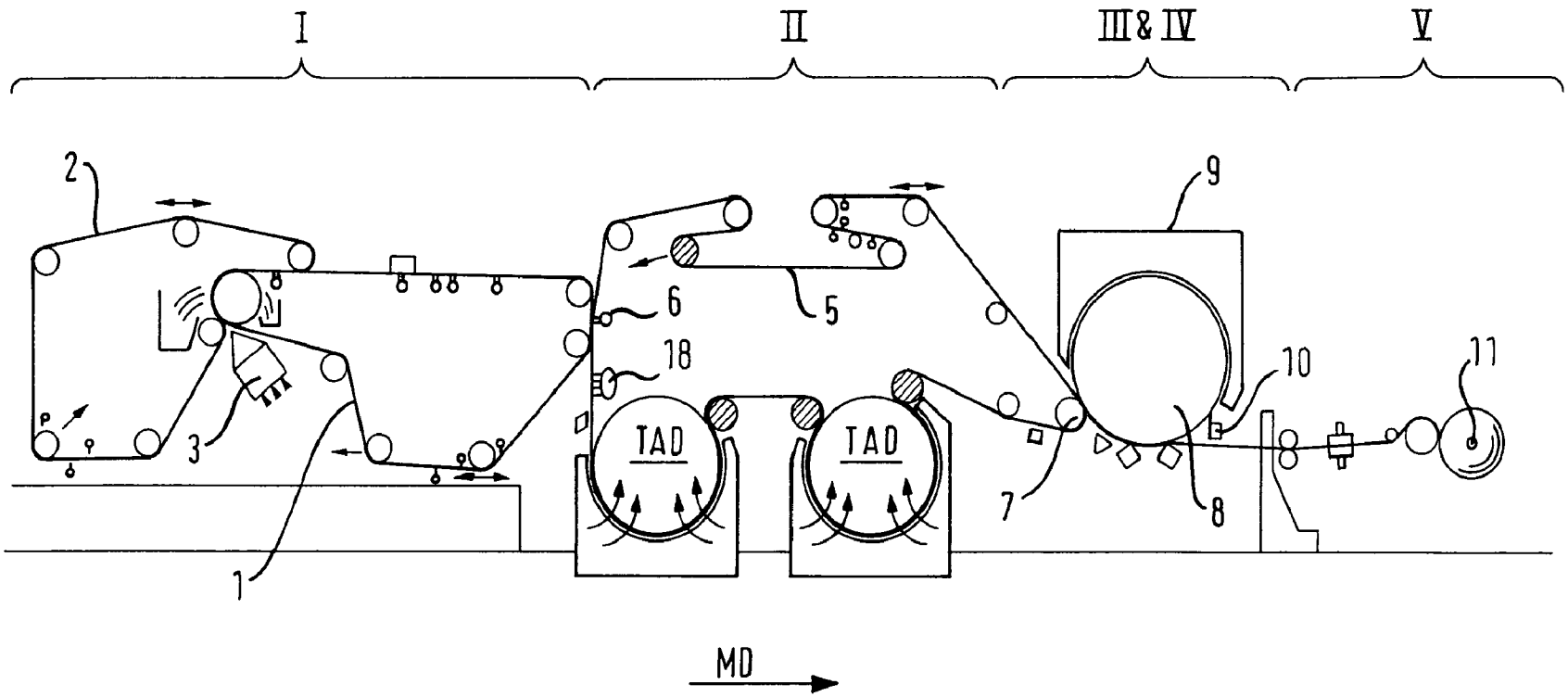
FIG. 1 shows an example of a paper machine having a TAD section and a Yankee cylinder as drying section.

Referring to FIG. 1, the course of manufacturing tissue in the form of a web is explained. The tissue web may be used as one ply in a tissue product. The shown paper machine may be divided in five sections, the forming section I, the TAD section II, which may be alternatively a pressing section, the section III for the Yankee or other drying means, the creping section IV and other after treatments, the discharge or winding section V. In the forming section I two forming fabrics are provided, the inner forming fabric 1 and the outer forming fabric 2. The head box 3 injects pulp into a nip between the inner fabric 1 and the outer fabric 2. Subsequently, the web (not illustrated) is conveyed on top of the inner fabric 1. The inner fabric 1 of a conventional paper machine may be used to impart a certain three-dimensional pattern (wet-formed pattern) on one external surface of the web. This in general is known by the skilled person, so that no further details are considered necessary in this context.

Between the forming section I and the TAD section II the tissue paper web is transferred from the inner forming fabric 1 to a TAD fabric 5. This transfer is achieved by mating both fabrics 1 and 5 in a certain area. A vacuum box or pick-up shoe 6 is provided, which transfers the web from the inner forming fabric 1 onto the TAD fabric 5. In this course, the web is further drained. As a result of the vacuum box 6 positioned upstream the TAD-drums the tissue paper web and its fibers may be sucked into pockets formed between knuckles of the TAD fabric 5.

A possibility to achieve a three-dimensionality of the web is the so-called "rush-transfer". In the rush-transfer, the forming fabric 1 runs faster than the TAD fabric. Thus, the tissue ply web is shuffled together on the TAD fabric so that a three-dimensionality is achieved.

One mode to get more three-dimensionality is to have a further vacuum box 18, a so-called molding box, placed solely on the TAD fabric. As a result of this vacuum box 18 the tissue paper web and its fibers are sucked into pockets formed between knuckles of the TAD fabric 5. Hence, the fiber density of the web in the pockets of the fabric is less than in the area of the knuckles.

As a result, an intended three-dimensional pattern is formed on both opposed external surfaces of the web, i.e. not only the external surface in contact with the TAD fabric, but also the opposite external surface of the web. Both of these patterns (i.e. the fabric side pattern and the opposite side pattern) are also considered as being wet-formed.

The TAD fabric runs through a so-called TAD drum (in the depicted embodiment two drums) partly enclosed by a hood. In the embodiment of FIG. 1, hot air is blown from the hoods through the web into the TAD drum. The direction of blowing the hot air is shown in FIG. 1 by means of arrows. However, the direction of blowing the hot air can also be the other way round, i.e. the hot air may be blown from the drum through the web to the hood. This process of blowing hot air through the web gives this drying method its name TAD (through air drying). By means of this process, the wet-formed pattern imparted by the TAD fabric on the external surface/surfaces is fixed.

According to one possible embodiment, the web subsequently is transferred to a section III by means of a pressure roller using minimal pressure to a Yankee cylinder 8, where the web is further dried by means of drying hoods or a drying hood 9 and the wet-formed pattern is intensified by enhancing the density of the pattern portions having already high density, because the fabric knuckles are pressed against the yankee cylinder with the web positioned therebetween. According to section IV at the discharge end of the Yankee cylinder a so-called creping doctor 10 may also be provided so as to crepe the web at this position.

Finally, the web is wound in the winding section V.

The Manufacturing process of the tissue paper web is not described in more detail, because the process as such, as well as the apparatuses are well known in the art.

Figure 2:
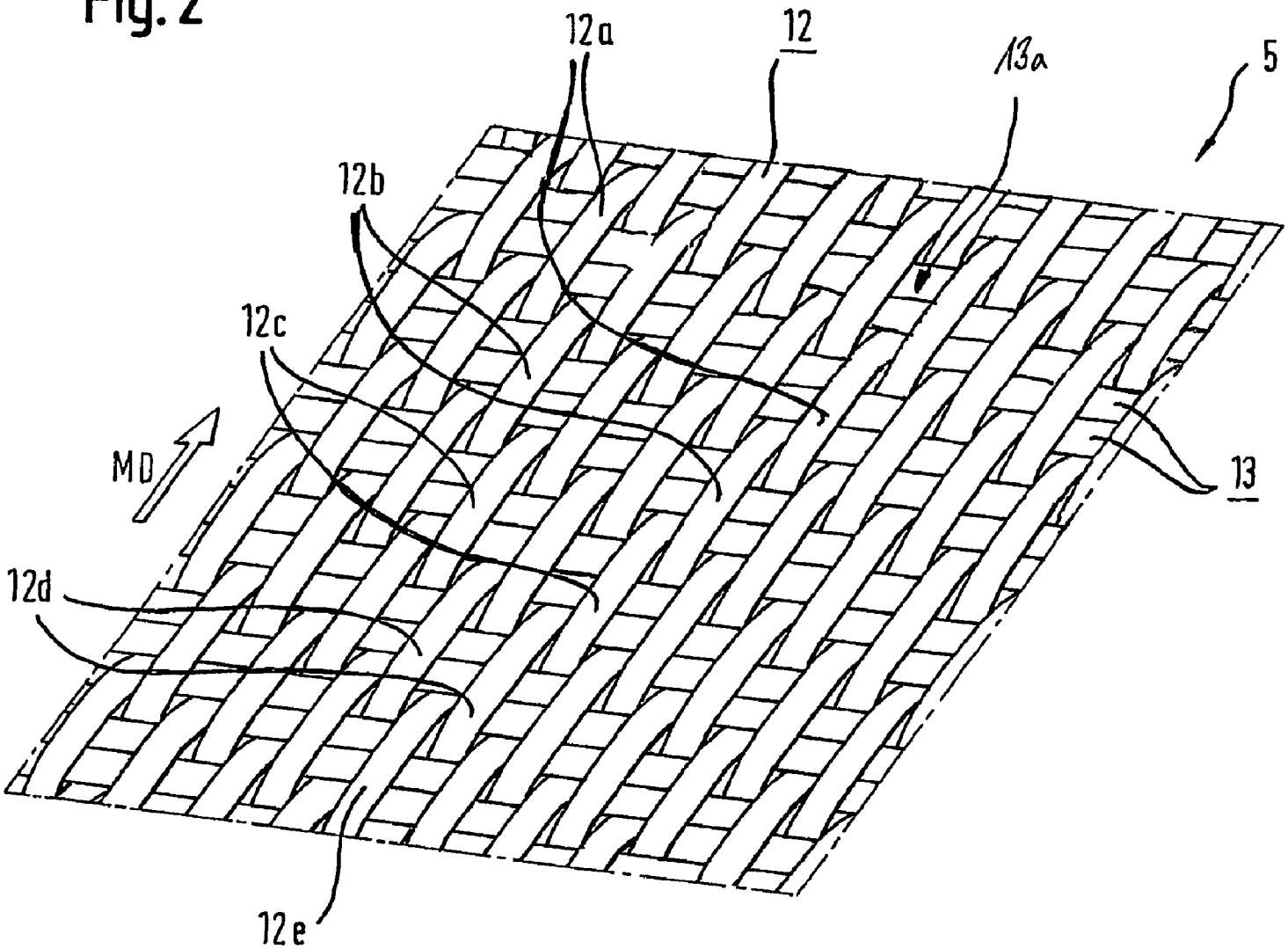
FIG. 2 is a perspective view showing the structure of a TAD fabric, that may serve as a master for the embossed pattern or the embossing pattern of the present invention.

FIG. 2 shows according to one of the plurality of embodiments the structure and the configuration of a TAD fabric 5 in a perspective view that may serve as a master for the wet-formed pattern to be imitated. The TAD fabric 5 in the shown embodiment is woven and consists of warp yarns 12 and weft yarns 13. In the shown embodiment the yarn 12 runs alternately over three weft yarns and under two weft yarns. The warp yarns 12 run in parallel to the machine direction MD, whereas the weft yarns 13 run in the cross machine direction CMD, i.e. perpendicular to the machine direction. In regard of the orientation of the weft and warp yarns, an aberration of approximately 10° may be present.

As it is clearly derivable from FIG. 2, the warp yarns 12 are spaced apart from each other perpendicular to the machine direction, i.e. in the cross machine direction, whereas the weft yarns 13 are spaced apart from each other parallel to the machine direction. Further, it is apparent from FIG. 2 that the portions of the warp yarns 12, which run over the weft yarns 13, i.e. the knuckles, line up in a row angled to the machine direction MD. For example, the knuckles 12*a* to 12*e* formed by the warp yarns form a diagonal angled to the machine direction MD. In other words a first knuckle 12*a* together with a second knuckle adjacent thereto in the cross machine direction, e.g. 12*b*, form a line angled to the machine direction. In the same way other diagonals are formed in other angles to MD by combining knuckles in another way.

Also, pockets 13*a* are formed in the sections in which the warp yarns 12 run under two weft yarns 13.

Though FIG. 2 only shows a perspective view of a TAD fabric 5, which serves as a master for an embossing pattern of the apparatus in accordance with the present invention, one embodiment of the inventive embossing pattern based on this depicted TAD fabric would substantially look the same except that compared to a woven fabric no apertures were present.

Figure 3:
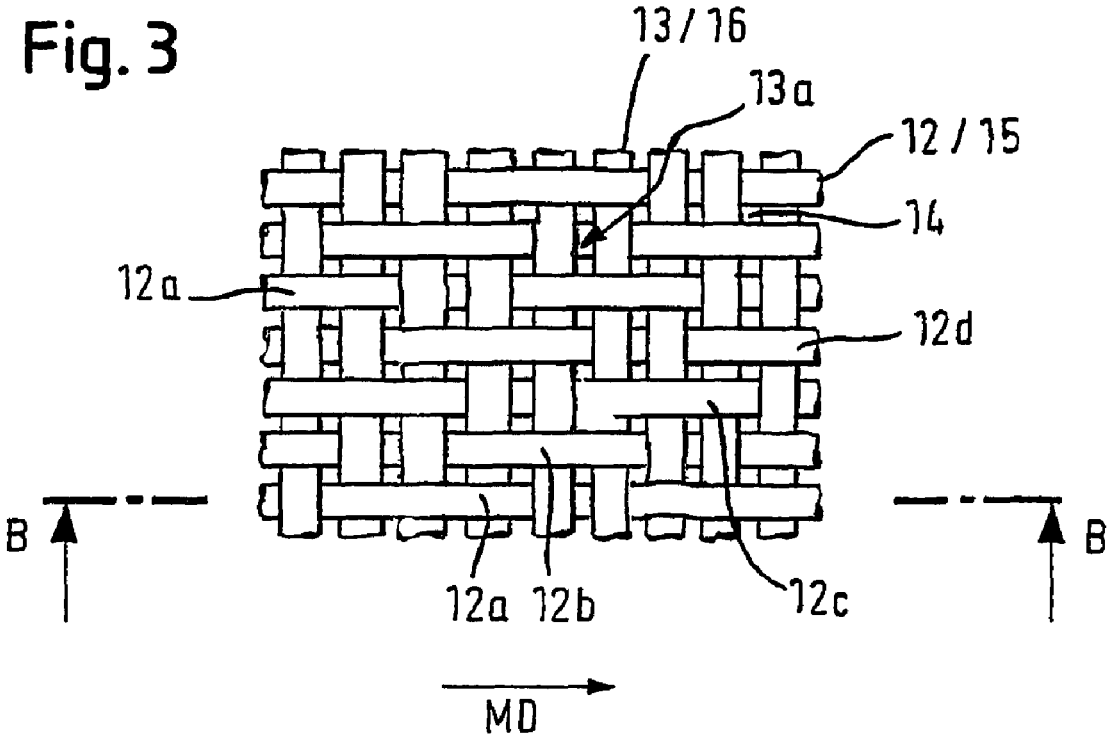
FIG. 3 is a plan view of alternatively a fabric of a paper machine and of an embossing pattern developed into a plane of an embossing roller according to one embodiment of the present invention.

Consequently, also a schematic plan view as shown in FIG. 3 on a TAD fabric, which serves as master for the surface of the embossing roller of the present invention would be the same as the plan view of the embossing pattern according to the present invention developed into a surface plane. In this context, "developed into a surface plane" means that the pattern of the embossing roller being in general cylindrical, so that the pattern is arcuate, is illustrated in a plane, rather than being arcuate.

In the following, the basic idea of the present invention is explained by means of one preferred embodiment of the present invention referring to FIGS. 3 to 5.

In the embodiment of FIG. 3, if considered as plan view of a TAD fabric, the warp yarns 12 run alternately over three weft yarns 13 and under two weft yarns 13. In addition, the knuckles of the warp yarns 12, i.e. the portions running over the weft yarns 13, line up in an angled orientation to the machine direction MD, as shown by the reference signs 12*a* to 12*d*.

Figure 4:
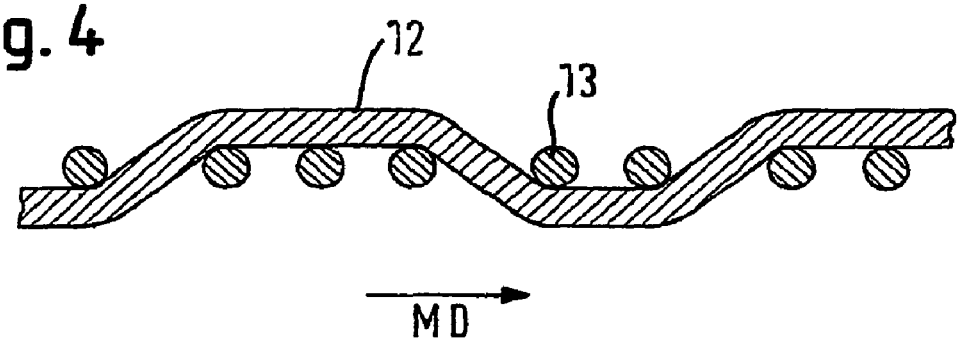
FIG. 4 is a cross-section along the line B-B in FIG. 3, wherein, in this case.

FIG. 4 shows a cross-section along the line B-B in FIG. 3, if the plan view in FIG. 3 is considered as a plan view of one example of a TAD fabric. It is also depicted in FIG. 4, that a warp yarn 12 alternately runs over three weft yarns 13 and under two weft yarns 13.

If FIG. 3 is viewed as an embossing pattern for an embossing roller in accordance with one embodiment of the present invention, wherein the embossing pattern is developed into a surface plane, the space between the weft yarns 13 and the warp yarns 12, which are referred to as 14, are not apertures as in a TAD fabric, but represent the lowest plane of the embossing pattern being of massive material. Further, in this case, the parts of the warp yarns 12 forming the knuckles 12*a* to 12*d* in the TAD fabric 15 form linear ridges lining up in a diagonal to the machine direction, as described above in regard of the TAD fabric of FIG. 2. The parts in which the warp yarns 12 run under the weft yarns 13 form pockets or depressions, though in the present case the parts of the weft yarns 16 are also visible in the surface topography of the embossing pattern (see FIG. 5).

According to the present invention, the surface topography of a fabric used in tissue manufacture (in the present preferred embodiment a TAD fabric) is the same as the surface topography of the inventive embossing pattern of the embossing roller of the embodiment of the present invention. For this reason, the plan view on the TAD fabric, as well as on the embossing pattern in accordance with the present invention is substantially the same. If the cross-section of an embossing pattern in accordance with the present invention is taken along the line B-B in FIG. 3, the cross-section shown in FIG. 5 may be drawn. The cross-section in FIG. 5 is substantially the same as the surface structure of FIG. 4. The uppermost surfaces of the warp yarns 12, as well as the uppermost surfaces of the weft yarns 13 together with the spaces between the warp yarns 12 and the weft yarns 13 as lowest plane 17 form a completely closed surface (surface topography).

Figure 5:
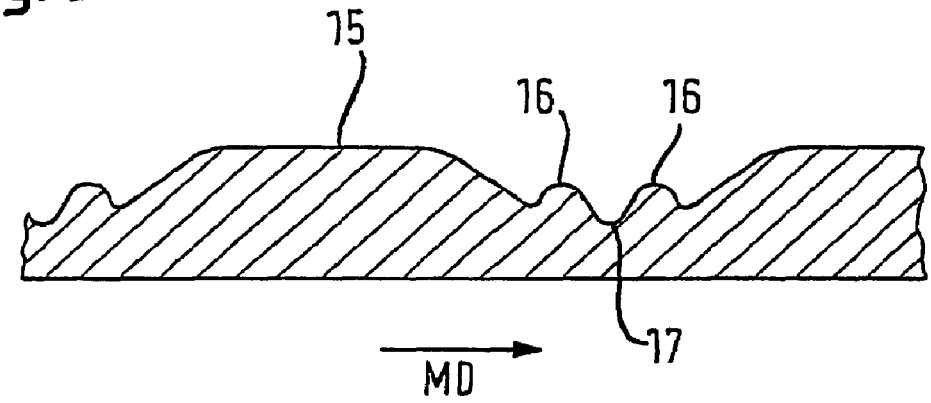
FIG. 5 is a cross-section along the line B-B in FIG. 3, wherein, in this case.

In FIG. 5, the linear ridges 15 and the recesses formed in between, i.e. in the area corresponding to that of the TAD-fabric in which the warp yarn 12 run under two weft yarns 13 are provided. Further, a third plane 17 is provided. The linear ridges 15 imitate the warp yarns 12, whereas the recesses imitate the pockets of the TAD-fabric. The low protrusions 16 imitate the weft yarns 13. Moreover, the third plane 17 forms a surface at which the apertures 14 in the TAD fabric between the warp yarns 12 and the weft yarns 13 usually are provided. Consequently, the embossing pattern shown in FIG. 5 and according to one embodiment of the present invention imitates a positive of a TAD fabric, as it is shown in FIG. 4 in cross-section. In other words, the surface topography of the one as well as of the other is substantially the same. Preferably, the embossing pattern of the present invention comprises less than 30 protrusions (in the aforesaid case linear ridges imitating the knuckles) per $cm^2$. Alternatively, the surface topography of the embossing pattern on the embossing roller may be the negative of that of the pattern of the TAD-fabric. In other words, the pattern that is imparted by the TAD-fabric to the fabric side (i.e. the side in contact with the fabric) of the ply in the wet state serves as master for the embossing pattern on the embossing roller. Thus, the parts of the warp yarn 12 forming the knuckles 12*a* to 12*e* in the TAD-fabric are recesses in the embossing pattern of the embossing roller and the parts of the pockets 13*a* in the TAD-fabric are the protrusions.

The present invention thus suggests an apparatus for embossing a tissue ply having an embossing roller and a counter roller. The embossing roller being preferably a steel roller and the counter roller being preferably a rubber roller. The embossing roller comprises an embossing pattern as for example shown in FIG. 3 in connection with FIG. 5. The embossing pattern has the surface topography for example of a TAD fabric, which is conventionally used in the manufacture of a TAD tissue ply and which imparts a pattern (wet-formed) on the external surface/surfaces of the tissue ply. Alternatively, the embossing pattern may also be a negative of the surface topography rather than the positive.

The apparatus of the present invention is preferably located downstream of a paper machine so that the embossing pattern is imparted to the tissue ply during further processing of the tissue ply, i.e. converting of the tissue ply. Alternatively, the apparatus may also be provided between the crepe doctor 10 and the winding 11.

In accordance with a preferred embodiment of the present invention, the surface topography of the embossing pattern is the negative of the surface topography of the TAD fabric 5 used to impart a wet-formed pattern on a tissue ply. In this embodiment, the tissue ply has a wet-formed pattern on both of its external surfaces. A rougher surface pattern is imparted on the fabric side of the ply and a smoother surface pattern is imparted on the opposite side. The surface topography of the smoother side substantially corresponds to the surface topography of the TAD-fabric. Hence, to impart a similar pattern also on the fabric side of the ply the fabric side of the ply is embossed with an embossing unit, wherein the embossing roller has the negative of the surface topography of the TAD-fabric. Thus, a one-ply tissue product may be achieved having two similar appearing surfaces. By applying an embossing pattern on the rough side, the roughness is partly overcome and the dry surface feeling is similar to the dry surface feeling on the smoother side, i.e. the side opposite the fabric side. In case the fabric side pattern is to be imitated, the smoother side is embossed by means of an embossing roller, whose surface topography is substantially the same as the surface topography of the TAD-fabric. Also in this case the two-sideness of the one-ply product may be avoided. The present invention, however, is not limited to the TAD manufacture, and the surface topography of the embossing pattern does not necessarily have to be the same as the surface topography of a TAD fabric. In fact, the surface topography of a forming fabric 1 or transfer fabric (not shown) may be used. In addition, if a fabric is used, the fabric does not necessarily have to be woven. In fact, the present invention comprises all kinds of fabrics and other means used for paper manufacture, which impart a pattern to the web in the wet-state (i.e. up to dryness values of the web of approximately 40%).

The present invention may, on the one hand, be used for a one-ply tissue product described above, as well as, on the other hand, for a multi-ply tissue product. Thus, for example, a TAD ply and a tissue ply of another process may be mated as outer plies, wherein the latter is provided with the inventive embossing pattern so as to imitate one of the external surfaces of the TAD ply. Preferably, the aforementioned smoother surface (side opposite to the fabric side) of the TAD-ply will be used as external surface of the one outer ply in the multi-ply tissue product of the present invention. The other outer ply of other kind, which preferably is a tissue ply not being provided with a wet-formed pattern of any kind, will be embossed by means of an embossing roller having the negative surface topography of a TAD-fabric. Subsequently, both plies are brought together so that one external surface is the external surface having the TAD pattern (in the present example the smoother side) produced by the TAD fabric and the other external surface is the external surface having the embossed pattern imitating the wet-formed TAD pattern. There might also be additional plies between two outer plies, the intermediate ply or plies may be TAD or other tissue. Thus, the appearance of the tissue product is improved in that both external surfaces look the same and the properties of the product may be adapted to the respective use.

Particularly preferred is a tissue product having two plies or three plies. One outer ply being a non-wet-formed tissue (i.e. a tissue not intentionally being provided with a pattern in the wet state) being provided with an inventive embossing on one external surface. The second outer ply being a TAD ply having on one external surface a "TAD-pattern". Both outer plies are brought together so that their aforementioned external surfaces represent the two external surfaces of the final tissue product. In this context, the external surface of a TAD ply is preferably the surface, which in the above described TAD manufacturing process comes in contact with the Yankee cylinder, i.e. the surface of the tissue ply, which is opposite to the fabric side. Nevertheless, as mentioned before, also this surface is provided with a wet-formed TAD pattern. The above product is particularly advantageous, because both external surfaces of the tissue product are optically the same, though both outer tissue plies are manufactured on different paper machines. Thus, tissue products combining the properties of two different manufactured plies (dry creped and TAD) in one product may be manufactured without inferring the optical appearance or the dry surface feeling of the tissue product. This leads to increased flexibility in regard of the product properties and to decreased costs with respect to product using only TAD plies. Most important, all this can be achieved without inferring the optical appearance or the dry surface feeling, such as e.g. smoothness, of the product with respect to two-sideness. Further, an embossed paper will have a slight improvement of absorption and absorption rate, which of course also will have an overall effect on the multi-ply product. In addition if a tissue ply is used, which has no wet-formed pattern, its printability is greatly improved compared to a TAD-ply.

As the one-ply, as well as the multi-ply tissue product of the present invention is produced by means of the embossing unit including the embossing roller with the above embossing pattern, as described above, the protrusions of the embossing roller imitating knuckles of e.g. a TAD-fabric form knuckle imprints in the ply having the embossed pattern the knuckle imprints lining up in linear depressions forming a diagonal to the machine direction and the cross machine direction (as the knuckle imprints imparted by the TAD-fabric in the wet-state). If the surface topography of the embossing roller is the negative of the surface topography of the TAD-fabric, the knuckles of the TAD-fabric form recesses in the embossing pattern of the embossing roller and the pockets of the TAD-fabric form protrusions in the embossing pattern of the embossing roller. Hence, in the corresponding product, the knuckle imprints lining up in pads or protrusions forming a diagonal to the machine direction and the cross machine direction. In this case the protrusions (pocket imprints) form depressions in the embossed ply. Hence, it depends on the pattern to be imitated whether the knuckle imprints are depressions or protrusions in the embossed pattern of the ply. The same applies to the pocket imprints.

Finally, it is indicated that the present invention is particularly suitable in the field of hygiene tissue products, such as handkerchiefs, toilet paper, kitchen rolls, hand towels, object wiping and similar.

Please note, that the above description of preferred embodiments of the present invention is not intended to limit the scope of the present invention, as defined in the appended claims.

The invention claimed is:

1. A one-ply tissue product, comprising:

a first external surface having a wet-formed pattern; and a second external surface having an embossed pattern that has a surface topography similar to or the same as that of the wet-formed pattern, wherein the embossed pattern represents protrusions or recesses imitating knuckles of a TAD-fabric form forming a diagonal to a machine direction and a cross machine direction.

2. The tissue product according to claim 1, wherein the embossed pattern has pocket and knuckle imprints.

3. The tissue product according to claim 2, wherein the knuckle imprints extend substantially in parallel to a machine direction and are spaced apart from each other in a cross machine direction, the knuckle imprints lining up in a direction angled to the machine direction and the cross machine direction.

4. The tissue product according to claim 1, wherein the embossed pattern comprises less than 30 protrusions/$cm^2$.

5. The tissue product according to claim 1, wherein the embossed pattern has a textile-like surface topography.

6. The tissue product according to claim 1, wherein the wet-formed pattern is formed by means selected from a forming fabric, a TAD-fabric, a transfer fabric, a felt, a belt, a roller or combinations thereof.

* * * * *